United States Patent [19]

Troiano

[11] Patent Number: 4,581,959

[45] Date of Patent: Apr. 15, 1986

[54] LOCKING FLEX HEAD TOOL

[76] Inventor: Joseph Troiano, 80 Mahan St., West Babylon, N.Y. 11704

[21] Appl. No.: 694,139

[22] Filed: Jan. 23, 1985

[51] Int. Cl.[4] ..... B25B 13/00
[52] U.S. Cl. ..... 81/177.9
[58] Field of Search ..... 81/177.1, 177.9, 177.7; 403/93, 96, 328

[56] References Cited

U.S. PATENT DOCUMENTS 2,886,998 5/1959 Scott ..... 81/177.9
3,383,962 5/1968 Harris ..... 81/177.9

FOREIGN PATENT DOCUMENTS 575169 2/1946 United Kingdom ..... 81/177.9

*Primary Examiner*—James L. Jones, Jr.
*Attorney, Agent, or Firm*—Richard L. Miller

[57] ABSTRACT

A locking flex head tool is provided and consists of a device for swiveling a tool head portion to a plurality of fixed positions with respect to a handle portion.

2 Claims, 4 Drawing Figures

LOCKING FLEX HEAD TOOL

BACKGROUND OF THE INVENTION

The instant invention relates generally to tools and more specifically it relates to a locking flex head tool.

Numerous ratchet and socket wrench tools have been provided in prior art that are adapted to freely swivel their flex heads a full one hundred and eighty degrees. While these prior art units may be suitable for the particular purpose to which they address, they would not be suitable as heretofore described.

SUMMARY OF THE INVENTION

A principle object of the present invention is to provide a locking flex head tool that has a device for swiveling its tool head portion to a plurality of fixed positions with respect to its handle portion.

Another object is to provide a locking flex head tool that includes within the device an octagonal parallelepiped and a spring loaded contact pin.

An additional object is to provide a locking flex head tool that contains an adjustment knob to control stability of the tool head portion and also allow the tool head portion to swivel to another position.

A further object is to provide a locking flex head tool that is simple and easy to use.

A still further object is to provide a locking flex head tool that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only and that changes may be made in the specific construction illustrated and described within the scope of the appended claims.

BRIEF DESCRIPTION OF THE DRAWING FIGURES

The figures in the drawings are briefly described as follows:

FIG. 1 perspective view of the invention.

Figure 4:
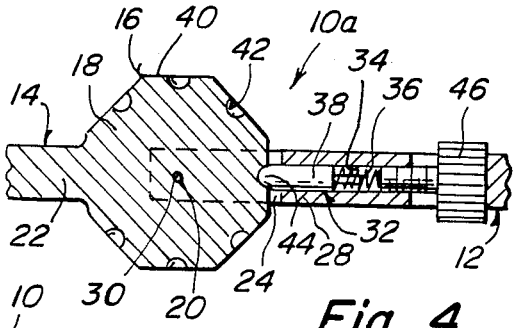
Figure 3:
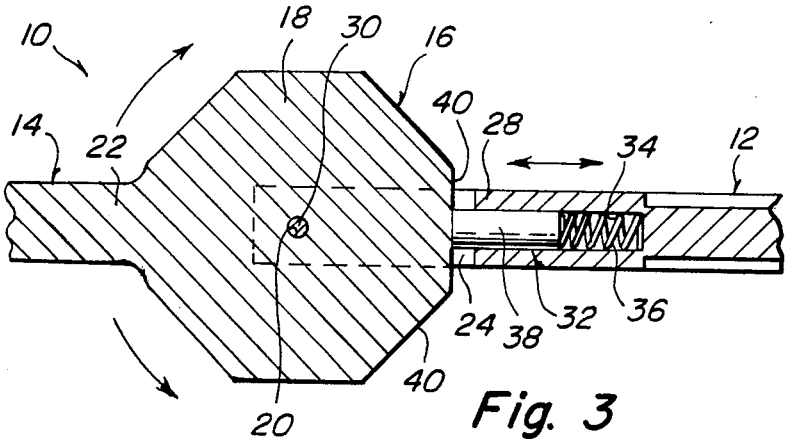
FIG. 3 is an enlarged cross sectional view taken on line 3—3 in FIG. 1.

FIG. 4 a cross sectional view similar to FIG. 3 but on a smaller scale showing a modification thereof.

DETAILED DESCRIPTION OF THE PREFERRED EMBODIMENTS

Figure 1:
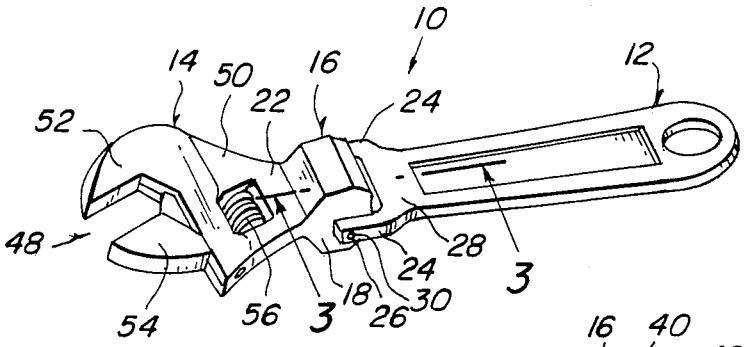
Figure 2:
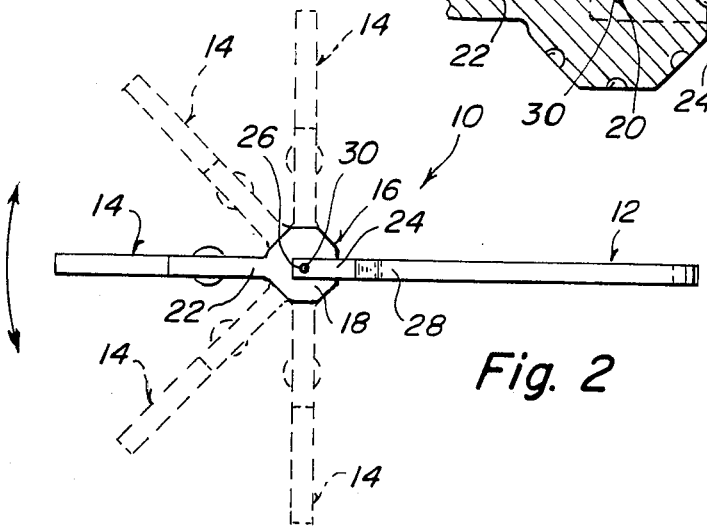
FIG. 2 is a side view thereof illustrating the flex head in various positions.

Turning now descriptively to the drawings, in which similar reference characters denote similar elements throughout the several views, FIGS. 1 through 3 illustrates a locking flex head tool 10 that contains an elongated handle portion 12, a tool head portion 14 and a device 16 for swiveling the tool head portion 14 to a plurality of fixed positions with respect to the handle portion 12.

The device 16 contains an octagonal parallelepiped 18 that has a central hole 20 therethrough and is affixed to end 22 of the tool head portion 14. A pair of spaced arms 24, 24 each have a hole 26 therethrough and is affixed to end 28 of the handle portion 12. An axle 30 extends through the holes 26, 26 in the arms 24, 24 and the central hole 20 of the octagonal parallelepiped 18 so that the tool head portion 14 can swivel.

As best seen in FIG. 3, a device 32 is for holding the octagonal parallelepiped 18 in a fixed position. The handle portion 12 has a longitudinal bore 34 between the arms 24, 24. A spring 36 is placed within the bore 34 and a contact pin 38 is also placed within the bore. The spring 36 will press the contact pin 38 against one side 40 of the octagonal parallelepiped 18 holding the tool head portion 14 in a fixed position.

FIG. 4 shows a modified locking flex head tool 10*a*. Each side 40 of the octagonal parallelepiped 18 has a indent 42. The contact pin 38 has a curved end 44 for engagement with each one of the indents 42 to increase stability of the tool head portion 14 in the fixed position.

An adjustment knob 46 is also provided and is mounted within the handle portion 12 adjacent the spring 36. When the adjustment knob 46 is turned in one direction, pressure on the spring 36 will increase forcing the spherical end 44 of the contact pin 38 harder into one indent 42 to control stability of the tool head portion 14. If the adjustment knob is turned to the tightest position it will compress spring 36 until thread shank on knob 46 will abut against a small pin extending out of right hand end of pin 38 (as best seen in FIG. 4) causing tool head position to be locked fixed in any of various positions. When the adjustment knob 46 is turned in other direction, pressure on the spring 36 will decrease so that the tool head portion 14 can be more easily manually swiveled to another position.

The tool head portion 14 as best seen in FIG. 1 is illustrated as an adjustable open end wrench 48 that has a web area 50, a stationary fixed jaw 52, a sliding movable jaw 54 and an adjustment screw 56 to control movement of jaw 54, however it is to be understood that any number of other type of tool heads could be substituted by one not even skilled in the art.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A locking flex head tool which comprises:

(a) an elongated handle portion;

(b) a tool head portion;

(c) means for swiveling said tool head portion to a plurality of fixed positions with respect to said handle portion;

(d) an octagonal parallelepiped having a central hole therethrough affixed to end of said tool head portion;

(e) a pair of spaced arms each having a hole therethrough and affixed to end of said handle portion;

(f) an axle extending through said holes in said arms and said central hole in said octagonal parallelepiped so that said tool head portion can swivel;

(g) means for holding said octagonal parallelepiped in a fixed position;

(h) said handle portion having a longitudinal bore between said arms;

(i) a spring placed within said bore;

(j) a contact pin placed within said bore so that said spring will press said contact pin against one side of said octagonal parallelepiped holding said tool head portion in a fixed position;

(k) each said side of said octagonal parallelepiped having a indent;

(l) said contact pin having a spherical end for engagement with each one of said indents to increase stability of said tool head portion in said fixed position; and (m) an adjustment knob mounted within said handle portion adjacent said spring so that when said adjustment knob is turned in one direction pressure on said spring will increase forcing said spherical end of said contact pin into one said indent to control stability of said tool head portion and when said adjustment knob is turned in other direction pressure on said spring will decrease so that said tool head portion can be manually swiveled to another position.

2. A locking flex head tool as recited in claim 1 wherein said tool head portion is an adjustable open end wrench.

* * * * *